US005115844A

United States Patent [19]

Hansen

[11] Patent Number: 5,115,844

[45] Date of Patent: May 26, 1992

[54] APPARATUS FOR INJECTING GLUE IN JOINTS AND HAIR CHECKS OF WOOD, ESPECIALLY FOR GLUING LOOSE KNOTS IN WOODEN BOARDS

[75] Inventor: Torben Hansen, Murnau/Hechendorf, Fed. Rep. of Germany

[73] Assignee: Schotten & Hansen GmbH, Fed. Rep. of Germany

[21] Appl. No.: 678,032

[22] Filed: Apr. 1, 1991

[30] Foreign Application Priority Data

May 22, 1990 [DE] Fed. Rep. of Germany ..... 4016460
Dec. 1, 1990 [EP] European Pat. Off. ..... 90123049.0

[51] Int. Cl.[5] ..... B27C 9/00; B27G 1/00

[52] U.S. Cl. ..... 144/2 R; 118/410; 118/710; 144/332

[58] Field of Search ..... 118/410, 411, 711, 710; 144/2 R, 2 E, 2 M, 332; 156/94

[56] References Cited

U.S. PATENT DOCUMENTS 2,335,528 11/1943 Neils .
2,336,704 12/1943 Skoog ..... 144/332
2,346,879 4/1944 Turzillo ..... 118/711
2,834,050 5/1958 Dymsza et al. ..... 118/711

FOREIGN PATENT DOCUMENTS 3316235 11/1984 Fed. Rep. of Germany .
645057 9/1984 Switzerland .

*Primary Examiner*—W. Donald Bray
*Attorney, Agent, or Firm*—Hill, Van Santen, Steadman & Simpson

[57] ABSTRACT

An apparatus with a percussion head disposed beneath a percussion rod of a percussion mechanism. The bottom surface of the percussion head includes a shallow, open-bottomed chamber which is defined by an axially compliant sealing ring, and is adapted to be filled with glue or plastics material to be injected into joints, hair checks, and knots of wooden boards.

15 Claims, 4 Drawing Sheets

FIG. 1
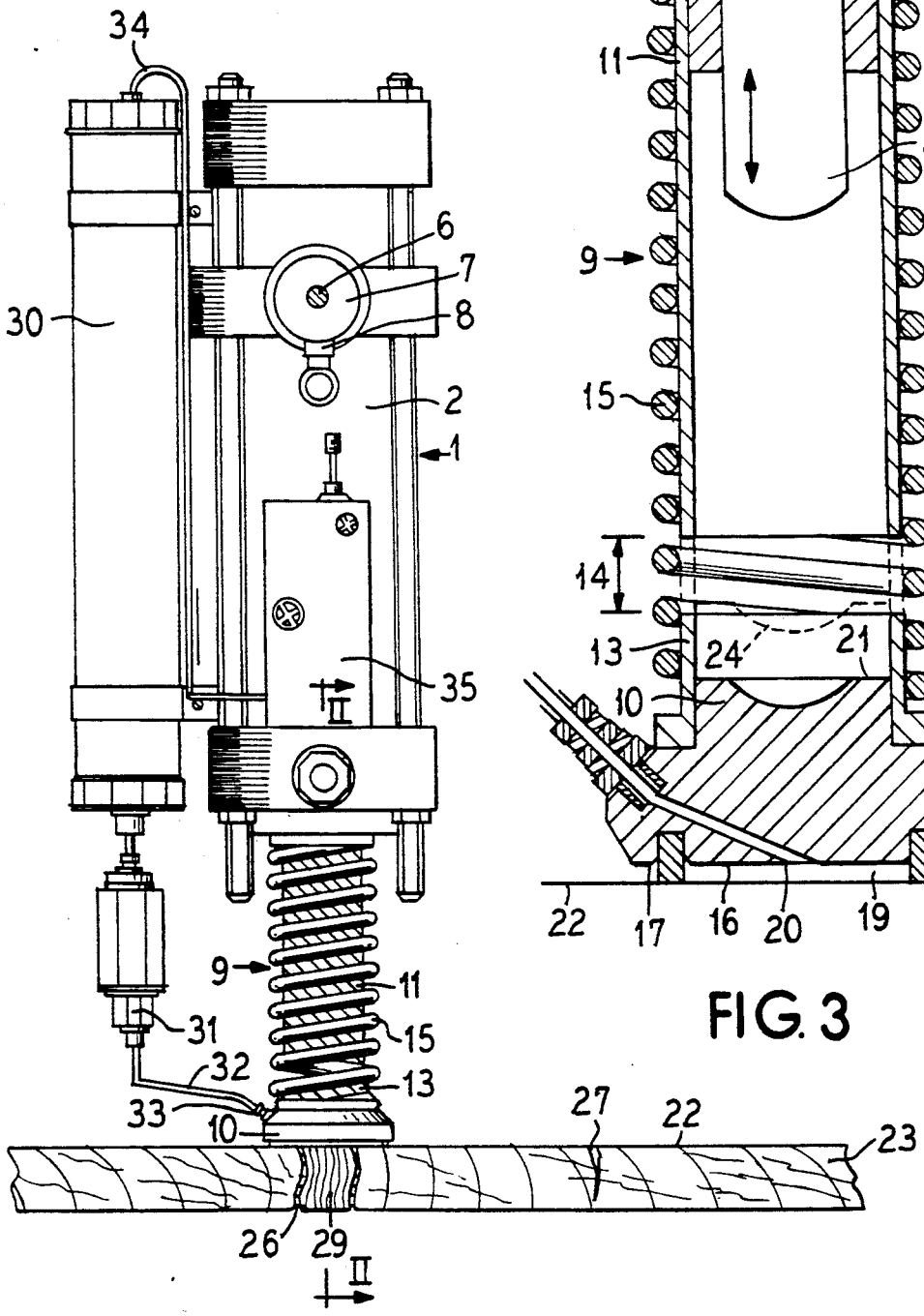
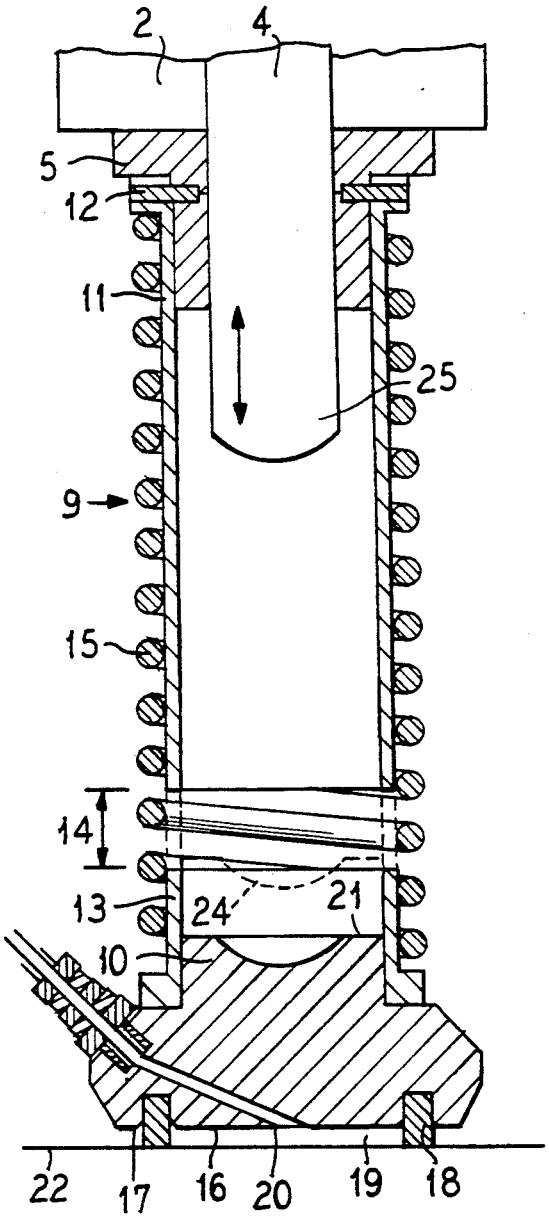
FIG. 3

APPARATUS FOR INJECTING GLUE IN JOINTS AND HAIR CHECKS OF WOOD, ESPECIALLY FOR GLUING LOOSE KNOTS IN WOODEN BOARDS

BACKGROUND OF THE INVENTION

1. Field of the Invention

The present invention is directed to an apparatus for injecting glue in joints and hair checks of wood, for instance for gluing loose knots in wooden boards.

2. Description of the Prior Art

When softwood boards of spruce, pine, or larch, or hardwood boards of maple or beech, are dried, hair checks are formed and the knots become loose due to shrinking. Those loose knots which do not drop out immediately after drying are likely to splinter during further processing, such as planing. Very knotty boards are therefore almost worthless and can be used or traded only as low-grade wood.

Known devices are directed to gluing such loose knots in the board by injecting glue at an overpressure into the gap between knot and board (see e.g. Swiss Patent No. 645,057, German OS 3,316,235 and U.S. Pat. No. 2,335,528). However, these devices are relatively bulky, and require that the glue injection head must be kept forcefully pressed against the wood surface, since otherwise the glue would escape from the sides of the injection head. The bulk and force inherent in such devices causes damage to wood surfaces, and the devices can be used only as stationary machines in which the board must be placed between the glue and injection head mounted on the upper portion of a frame and a supporting surface provided therebeneath.

U.S. Pat. No. 2,346,879 discloses apparatus for pressing cement into cracks of concrete slabs, in which the injection pressure is produced by a percussion device. The cement to be injected is introduced into a chamber, the bottom of which is formed with an injection opening to be placed onto the concrete slab, and the top of which is defined by a membrane which is struck by a percussion piston of a percussion device. The impact pulse acting on the membrane causes the cement to be ejected at high pressure from the injection opening of the chamber bottom. This apparatus is in no way related to the problems of injecting glue into wood surfaces, and furthermore has only a very small injection opening, and would be unsuitable for gluing loose knots in boards.

SUMMARY OF THE INVENTION

It is therefore an object of the present invention to provide a hand-held device adapted for injection of glue in relatively deep joints or hair checks of wooden boards, so that even unskilled persons will be capable of readily gluing loose knots.

This and other objects of the invention are achieved by the provision of an apparatus for injecting glue into wooden boards which includes a percussion mechanism having a selectively actual percussion rod associated with a percussion head. A supporting assembly holds the percussion head in such a way so as to permit limited axial movement of the percussion head beneath the percussion rod. An axially compliant sealing ring on the underside of the percussion head defines a shallow, open-bottomed chamber. A glue supply is provided for selectively filling the chamber with glue, and the percussion rod may be selectively actuated to strike a top surface of the percussion head.

In another embodiment of the present invention, glue may be metered using a reciprocating pump carried by the percussion head. The reciprocating pump may include a pump cylinder, with a pump piston axially reciprocable therein. The pump piston has a free end protruding downwardly into the open-bottomed chamber, and a pump space is formed in the cylinder above the pump piston. A spring arrangement may be provided for biasing the pump piston in a downward direction, and a piston duct, formed in the pump piston, as connected between the pump space and the chamber.

In this embodiment, pressing the apparatus against the board surface causes glue in the pump space to flow through the piston duct and into the chamber, after which the percussion mechanism may be actuated. Upon lifting of the apparatus off the board surface, the spring arrangement re-extends the piston downwardly, thus creating a vacuum in the pump space sufficient to cause glue to flow from a storage container into the pump space.

An apparatus according to the present invention is simply placed without any major pressure on the faulty portion of the board. One or several successive blows of the percussion device on the percussion head will cause the sealing ring on the underside of the percussion head to be axially compressed, whereby the glue enclosed in the shallow chamber is deeply injected without any damaging repercussion into the joint or crack of the board. The present invention eliminates the need for a counter-force for urging the device against the board surface, as required in known devices. The apparatus according to the invention is especially suited for gluing loose knots in dried wooden boards, whereby it is possible to produce low-cost, high-grade boards with strong knots, thus facilitating high-quality processing of wood. The present invention may also be used to glue narrow hair checks of boards prior to further processing, by repeated application of the device according to the invention. The diameter of the chamber on the underside of the percussion head depends on the respective application. A diameter of about 3 to 5 cm will generally suffice for gluing loose knots, because the most frequently occurring knots in softwood and hardwood boards can be encompassed by the sealing ring of such a chamber. The outline of the chamber of the sealing ring also depends on the respective application. In general, the sealing ring can be circular, although an ellipitical or even rectangular outline of the sealing ring is conceivable for certain applications. The device according to the present invention may also be used for injecting other viscous materials such as curable adhesives, varnishes, expandable viscous plastics, synthetic rubber, and multi-component adhesives. For injecting multi-component adhesives, it is contemplated that separate supply ducts will provide the respective components to the chamber of the percussion head. The apparatus according to the invention is not restricted to wood processing, but is also applicable for injecting viscous materials into narrow joints and cracks of synthetic or metallic materials.

The glue may be introduced in any desired manner into the chamber provided on the underside of the percussion head. In the simplest case, glue may be introduced into the chamber with a spatula, before the percussion head is placed on the board surface. Alternatively, a predetermined quantity of glue could be applied directly to the board surface. It is preferred, however, that the glue be automatically introduced into the chamber of the percussion head as the apparatus is placed in the working position. This is preferably done through a suitable metering arrangement and a supply duct in the percussion head. The supply rate and time are adjusted by the metering arrangement so that, with the percussion head in the working position, the closed chamber is completely filled with fluid before the stroke of the percussion mechanism is triggered.

The percussion mechanism may be of any known type, and the percussion impulse of the percussion piston can be produced either pneumatically, hydraulically, electrically or by corresponding explosive cartridges. Commonly used pneumatic percussion cylinders of the type used in nail guns are especially advantageous; however, common pneumatic riveting or chipping hammers (which can operate at 4000 blows per minute) may be used. It is contemplated that an apparatus according to the present invention could be made from such a commercially available percussion hammer by merely mounting the percussion head beneath the percussion piston through a suitable mounting means, and by providing the corresponding supply ducts for the glue which is to be injected. Common percussion drills may also be modified in constructing an embodiment of the present invention. The present invention is not only useful as a hand tool, but could also be used in stationary fashion. For example, the present invention could be employed in conjunction with suitable CNC-controlled machines in which the knots are detected electronically and are then automatically glued by way of the apparatus according to the present invention.

Other objects and advantages of the present invention will be apparent upon reference to the accompanying description when taken in conjunction with the following drawings.

BRIEF DESCRIPTION OF THE DRAWINGS

FIG. 1 illustrates a side elevational view of an apparatus embodying the present invention.

FIG. 3 illustrates a detailed part-sectional view of a percussion head and mounting structure.

DESCRIPTION OF THE PREFERRED EMBODIMENT

Figure 2:
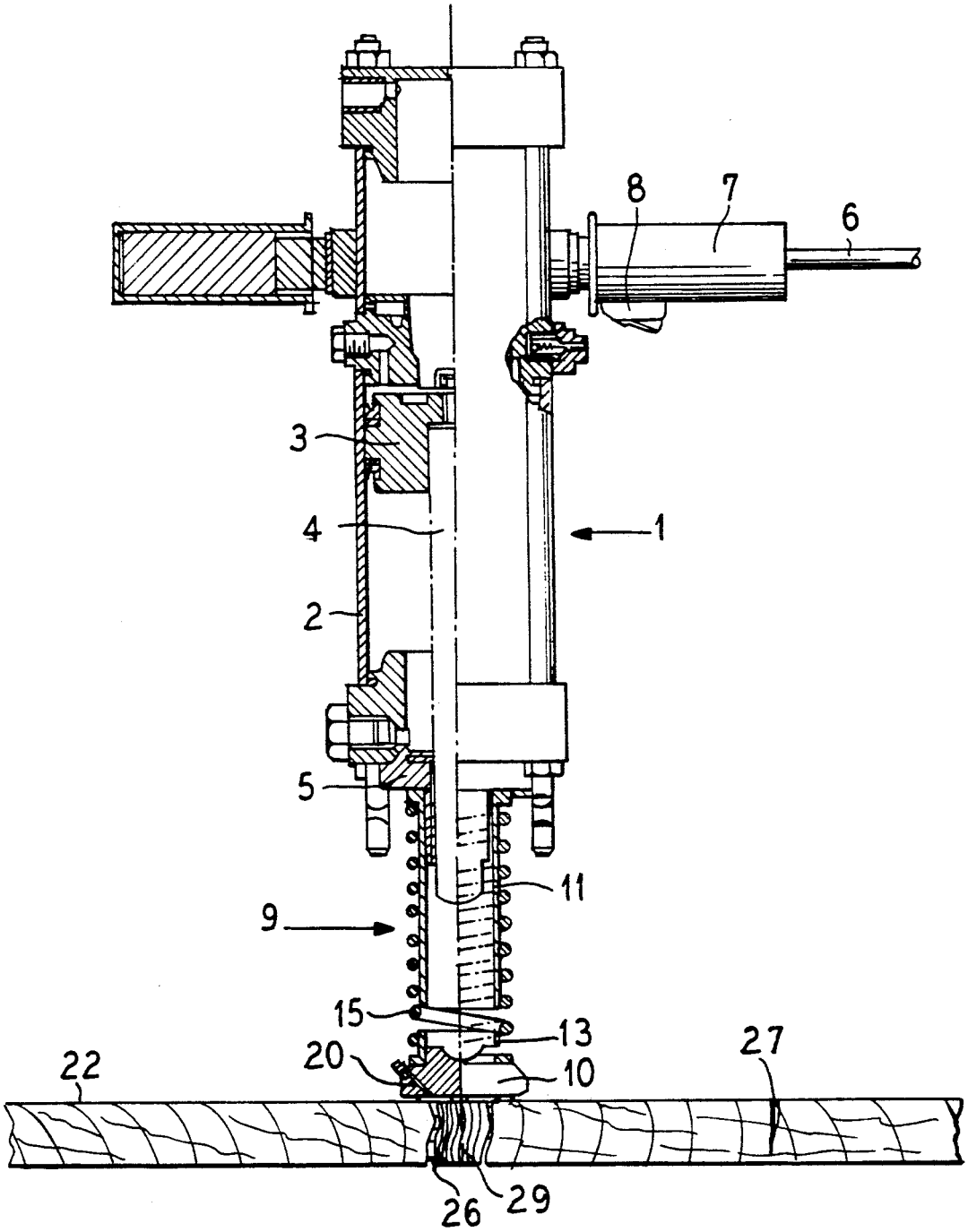
FIG. 2 illustrates a sectional view taken generally along lines II—II.

FIGS. 1-3 illustrate an embodiment of the present invention in conjunction with a commercially available pneumatic percussion tool 1. The tool 1 includes a cylindrical housing 2, in which a piston 3 is axially slideable and has a piston rod 4 which is mounted for axial movement in a bearing 5. Compressed air is supplied to the cylindrical spaces above and beneath the piston 3 through a conduit 6 and a control valve incorporated in a handle 7. The control valve 7 is operated via an actuating lever 8, so that the piston can be pneumatically moved in axial direction with high kinetic energy.

A percussion head 10 in accordance with the present invention is mounted through a supporting assembly 9 disposed adjacent the bottom end of the cylindrical housing 2, on a piston rod bearing 5 of the percussion tool 1. The supporting assembly 9 includes a bushing 11 fitted onto the cylindrical end of the piston rod bearing 5 and secured thereto by bolts 12. A bushing 13 of the same diameter as the busing 11 is secured to the percussion head 10, for example by bolts. A helical compression spring 15 is mounted on the bushings 11 and 13. The ends of the spring 15 are welded to the bushings 11 and 13 to maintain a predetermined axial space 14 between the bushings.

A sealing ring 18 of elastically compliant material (such as rubber or a suitable plastics material) is fitted in an annular groove 17 on the underside 16 of the percussion head 10. The outer periphery of the annular groove 17 is preferably flared outwardly in a funnel shape. The outer periphery has a cross-section such that, upon axial compression of the sealing ring 18, the elastically deformed ring material may be accommodated substantially completely within said annular groove 17. Together with the underside 16 of the percussion head 10, the elastic sealing ring 18 defines a circular chamber 19 through which glue is introduced via a duct 20.

The percussion piston or piston rod 4 is concentrically axially movable within the bushings 11 and 13. The distance 14 between the bushings and the length of said bushings is selected such that, when the piston rod 4 is at the end of its stroke and the spring 15 in its fully extended position (as illustrated in FIG. 3) the end 25 of the piston rod 4 will not reach the top 21 of the percussion head 10. This ensures that, in the fully extended position, the percussion mechanism cannot strike the percussion head. It is only when the tool is placed on the surface 22 of a board 23 to be processed, the spring 15 is compressed by slight pressure on the percussion cylinder, and that top 21 of the percussion head reaches approximately the position 24 illustrated in dashed lines in FIG. 3, that the end 25 of the piston rod also reaches the top 21 of the percussion head. In this position, the piston rod 4 is at a part of its working stroke where it provides maximum kinetic energy (above the drifting stroke). It is therefore in this position that the percussion tool acts with maximum percussion power on the percussion head. Preferably, the end 25 of the piston rod is rounded, and a complementary shallow portion is formed on the top 21 of the percussion head. All of the component parts are preferably made from stainless steel.

Operation of the present invention may be described with reference to gluing a loose knot 29, for example, in a wooden board 23. The percussion head 10 of the tool is initially placed on the surface 22 of the board so that the elastic sealing ring 18 encompasses the knothole. Then, the user presses the tool slightly downwards to compress the spring 15, and to bring the top of the percussion head to position 24. Either previously or concurrently with such axial depression of the tool, a quantity of glue sufficient to fill the chamber 19 is introduced from a storage container, via the duct 20, into the chamber. Thereupon, the percussion mechanism is operated by actuation of the trigger 8, the piston 3 is urged axially downwardly, and the end 25 of the piston rod 4 strikes the top 21 of the percussion head 10. Due to the resultant strong percussive impulse, the percussion head 10 is highly accelerated axially downwardly towards the surface 22 of the board, while the elastic sealing ring 18 is compressed axially. Although the stroke of the percussion head due to the blow is only a few millimeters, it is sufficient to press the glue contained in the chamber 19 deeply into the annular gap 26 of the knot 29. The sequence of operations described is identical to the sequence that would be used to glue hair checks 27 in the board surface.

The cross-section and the elastic material of the sealing ring 18 are selected so that the sealing ring 18 is easily compressed axially. However, the sealing ring must prevent glue from being squeezed radially outwardly past the side faces of the sealing ring, forcing the glue to be pressed substantially downwardly into the gap 26. This may be achieved for example, by selecting a suitable cross-section of the sealing ring 18. In the simplest case, the sealing ring 18 may be a simple O-ring. However, it may be preferably to use a sealing ring 18 of approximately rectangular or elliptical cross-section, i.e. a cross-section which is larger in its axial than in its radial dimension. Lip seals may be used to substantially prevent glue from escaping radially outwardly. Also, it may be advantageous to cover the bottom side of the percussion head 10 (i.e. the bottom of the chamber) with an elastically compliant cover layer, so as to prevent any damage to the top of the material when the percussion head strikes. Further, the chamber 19 may be formed by a suitable elastic cap placed onto the percussion head from below. Such a cap would integrally define both the sealing ring 18 and the elastic cover of the percussion head bottom. The sealing ring 18 may in some cases also consist of a harder material, provided that the sealing ring can be urged in axial direction by the impact of the percussion head to be elastically compliantly urged into the underside of the percussion head.

There are various ways to supply glue through the duct 20. In the illustrated embodiment of FIG. 1, a glue container 30 is mounted on the side of the percussion cylinder 1 which communicates with an inlet 33 of the duct 20 via a check valve 31 and a flexible tube 32. The upper portion of the glue container 30 is connected via a compressed-air line 34 with a compressed-air control valve 35. The valve 35 cooperates functionally with the compressed-air control valve of the percussion cylinder 1. The control of the valves is coordinated in such a way that, upon actuation of the trigger 8, compressed air is initially supplied via line 34 to the glue container 30. The control valve 35 may include a timer, whereby a delay period set in valve 35 allows a predetermined glue quantity to be injected by compressed air through the line 32 and the duct 20 into the chamber 19 of the percussion head, and the percussion mechanism is triggered to deliver a blow to the percussion head. The time delay set in the valve 35 may be adjusted depending on the type of glue, so that the chamber 19 is filled with glue before the compressed air is fed via the control valve 35 to the cylindrical spaces of the percussion mechanism 1 to trigger the blow.

For larger systems, for example, a system including a plurality of parallel-operated tools, it is possible to supply the tool with glue from a stationary glue storage container via an additional line in parallel to the compressed air. In such systems, a glue container need not be provided on the tool itself. As in the embodiment previously described, the check valve prevents any backflow of glue through the duct during actuation of the percussion mechanism.

Another method of controlling the supply of glue is to utilize the initial relative axial displacement between percussion head 10 and percussion cylinder 1 caused when the percussion head 10 is placed on top of the board either directly for glue supply or for controlling it. When a mechanical pumping mechanism of the kind common in spray bottles is provided in the glue container 30, the relative movement caused by placing of the tool may simultaneously actuate the pump plunger by way of a mechanical link between the pumping mechanism and the percussion head, whereby a predetermined quantity of glue is injected via the duct 20 into the chamber 19. This initial relative movement could also be used for operating a corresponding control valve (which could, for example, be operatively connected to the valve 35) so that glue can be forced into the chamber 19 only when the percussion head is pressed against the surface of a material.

Figure 4:
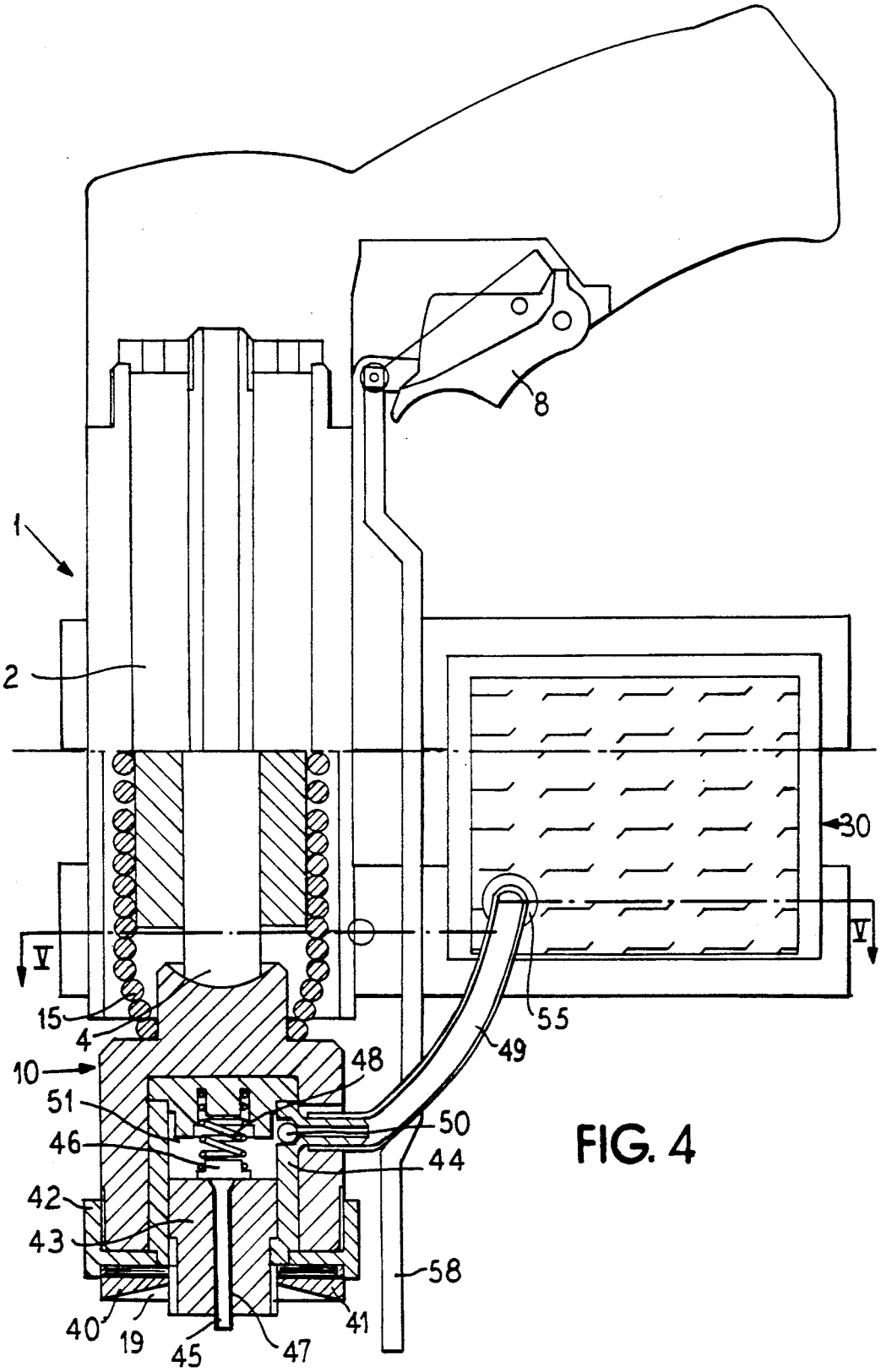
FIG. 4 illustrates a sectional view of another apparatus embodying the present invention.
Figure 5:
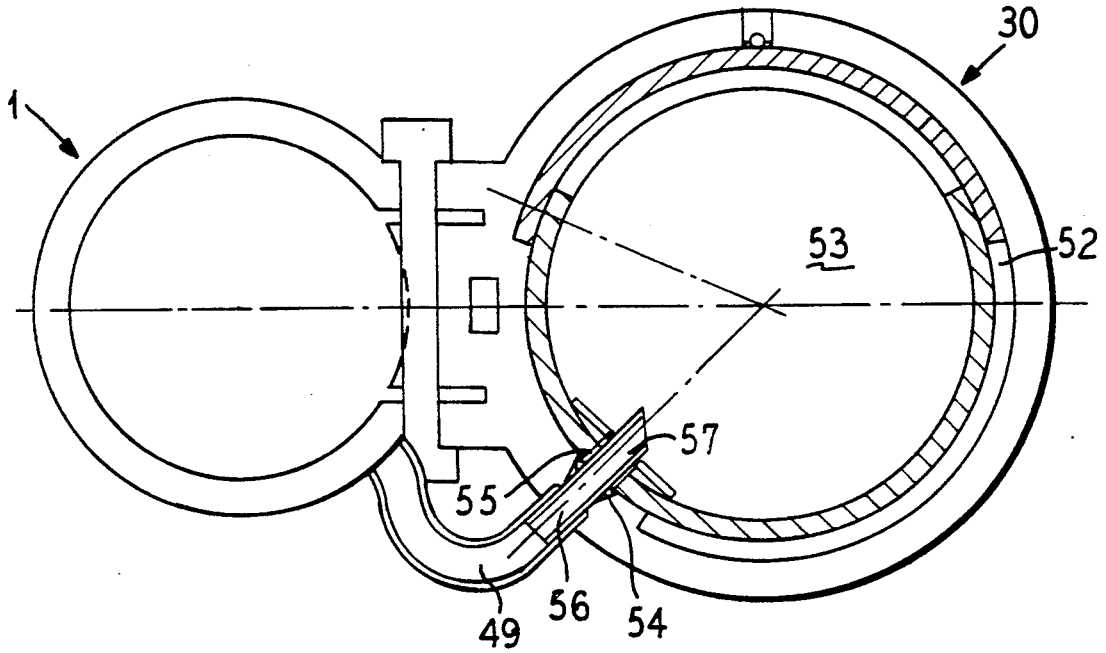
FIG. 5 illustrates a cross-sectional view taken generally along the line V—V of FIG. 4.

FIGS. 4 and 5 illustrate a further embodiment of a tool according to the present invention, in which a percussion head 10' is mounted by way of a helical compression spring 15' for limited axial movement beneath the percussion piston 4' of a pneumatic percussion tool 1'. The top end of the helical compression spring 15' is fitted onto the lower end of the cylindrical housing 2', and the percussion head 10' is fitted, with a retaining portion, into the lower end of the helical compression spring 15'. In this embodiment, the glue chamber 19' is disposed on the underside of the percussion head 10' by a rubber ring 40 of approximately triangular cross-section, with the outer annular lip of the ring 40 defining the chamber 19'. The rubber ring 40 is vulcanized onto the top surface of a replaceable metallic ring 41 which is capable of being threaded onto a retaining member 42. The retaining member 42 is, in turn, threadingly engaged with the percussion head 10'. A reciprocating pump is provided within the percussion head 10', and includes an axially displaceable piston 43 and a cylinder 44 fitted in the percussion head 10'. A pin 45 is mounted in the piston 43 for axial sliding movement. The upper end of the pin 45 is configured as a valve member 46, and blocks glue supply ducts 47, which are formed as longitudinally extending grooves on the outer periphery of the pin 45 in the wall of the piston 43, in which the pin 45 is housed. The longitudinal grooves 47 open into the end face of the piston 43, where additional radial glue supply grooves can be formed. The valve body 46 is urged by a compression spring 48 against the upper end face of the piston 43, and the spring 48 is simultaneously used to bias the piston 43 in downward direction. In its fully extended state, the end face of the piston 43 protrudes axially beyond the edge of the rubber ring 40 and, with the valve 46 being closed, the end of the pin 45 protrudes axially beyond the end face of the piston 43. Glue is supplied from the storage container 30' via a flexible conduit 49 and a check valve 50 into the pumping space 51. When the tool is placed on the surface of a board, the pin 45 is initially urged inwardly against the action of the spring 48 so that the valve body 46 is lifted, whereby the glue supply ducts 47 in the piston 43 are opened. As the tool is continued to be pressed axially downwardly, the piston 43 is moved axially upwardly against the biasing force of the spring 48. Movement of the piston 43 causes glue to be injected downwardly into the annular space 19 between rubber ring 40 and piston end 43 while the check valve 50 is being closed. Thereafter, the percussion mechanism is actuated to trigger a blow against the percussion head 10', so that glue is squeezed from the annular space 19' into the gap in the board. It has been found that it is advantageous when several blows are performed in succession, so that the glue is reliably and completely forced downwardly out of the annular chamber 19'. Upon removal of the device, the biasing force of the spring 48 closes the valve 46 and causes the piston 43 to be axially extended downwardly, whereby the check valve 50 is again opened and glue is drawn from the storage container 30' via the tube 49 into the pumping space 51, so that the device is prepared to perform the next gluing operation. Again, the percussion head 10' is made from hardened steel, while the piston pump 43, 44 preferably is made from plastics material. After removal of the retaining member 42, the various pump components can readily be exchanged and cleaned.

A safety rod 58 prevents premature striking of the percussion rod 41 against the top of the percussion head 10' prior to placement of the percussion head against the board surface 22. The safety rod 58 is linked with the trigger 8' of the percussion mechanism 1 such that the percussion mechanism 1' can be operated only when the percussion head 10' has been placed on the board surface, thus moving the safety rod 58 axially upwardly. When the percussion head 10' is lifted off the board surface, the safety rod 58 is immediately drawn axially downwardly by the action of the spring 58, whereby the supply of pressurized air to the percussion mechanism 1' is interrupted (even though the user may still operate the trigger 8'). Thus, the safety rod 58 ensures that actuation of the percussion mechanism 1 is interrupted immediately upon the device being lifted off the board surface.

FIG. 5 illustrates details of an especially advantageous configuration of the glue storage container. A cylindrical container 52 is mounted on the side of the housing of the percussion mechanism 1', and is adapted to be opened by rotation of two half-shells relative to each other, so that a glue-filled bag 53 may be inserted. An adaptor 54 of plastics material is attached to the side of the glue bag 53 for insertion and locking in a lateral aperture 55 of the container 52. The end of the glue supply tube 49 terminates in a piercing member 56, formed from sharp-edged piece of plastic pipe, which is inserted into the adaptor 54. When the piercing member 56 is fitted into the adaptor 54, it pierces a frangible membrane 57 closing the glue bag 53, so that glue may flow from the bag 53, through the tube 49, to the percussion head 10'. This arrangement permits simple and rapid replacement of an empty glue bag.

There are various possibilities in respect of the configuration of the supporting assembly 9 of the percussion head. The illustrated embodiments including a helical spring offer the advantage that the percussion head is capable not only of limited axial movement, but may also be tilted, to a limited extent, relative to the percussion axis, so as to accommodate irregularities in the board surface. However, it may be advantageous in certain situations to provide for exact axial guidance of the percussion head, for instance by giving the two bushings 11 and 13 a telescopic configuration. The design of the supporting assembly 9 may also be varied to be compatible with various percussion cylinders.

Although the present invention has been described with reference to a specific embodiment, those of skill in the art will recognize that changes may be made thereto without departing from the scope and spirit of the invention as set forth in the appended claims.

I claim as my invention:

1. An apparatus for injecting glue into wooden boards, said apparatus comprising:

a percussion mechanism including a selectively actuable percussion rod;

a percussion head;

supporting means for holding said percussion head and for permitting limited axial movement of said percussion head beneath said percussion rod;

an axially compliant sealing ring on an underside of said percussion head, said sealing ring defining a shallow, open-bottomed chamber;

glue supply means for selectively filling said chamber with glue; and actuation means for selectively causing said percussion rod to strike a top surface of said percussion head.

2. The apparatus as claimed in claim 1, wherein said percussion mechanism comprises a pneumatic percussion hammer.

3. The apparatus as claimed in claim 1, wherein said support means comprises a helical spring mounted with a first end thereof on a housing of said percussion mechanism and with a second end of said percussion head.

4. The apparatus as claimed in claim 1, wherein said sealing ring is formed from an elastically compliant material.

5. The apparatus as claimed in claim 4, wherein said sealing ring is fitted in an annular groove formed on said underside of the percussion head.

6. The apparatus as claimed in claim 4, wherein said sealing ring is vulcanized to the underside of said percussion head.

7. The apparatus as claimed in claim 1, wherein said glue supply means comprises:

a storage container;

a duct, formed in the percussion head leading from said storage container to said chamber; and a check valve between said duct and said storage container.

8. The apparatus as claimed in claim 1, further comprising that the metering means for controlling the quantity of glue from said glue supply means to said chamber.

9. The apparatus as claimed in claim 8, wherein said metering means is automatically operated when said apparatus is placed axially on the board surface.

10. The apparatus as claimed in claim 9, further wherein said metering means comprises a reciprocating pump carried by said percussion head, said reciprocating pump including:

a pump cylinder;

a pump piston axially reciprocable within said pump cylinder and having a free end protruding downwardly into said chamber;

a pump space formed in said cylinder above said pump piston;

spring means for biasing said pump piston in a downward direction; and a piston duct, formed in said pump piston, connected between said pump space and said chamber;

whereby pressing said apparatus against a board surface causes glue in said pump space to flow through said piston duct and into said chamber, and further whereby, upon lifting said apparatus off of said board surface, said spring means re-extends said piston downwardly, thus creating a vacuum in said pump space sufficient to cause glue to flow from said storage container into said pump space.

11. The apparatus as claimed in claim 10, further comprising a valve means for closing said piston duct is provided in said pump piston, said valve means being actuated by a pin axially projecting beyond said free end of said piston.

12. The apparatus as claimed in claim 1, further comprising safety means for preventing said percussion rod from striking said percussion head unless said percussion head has been placed on a board surface.

13. The apparatus as claimed in claim 7, wherein said storage container is attached to a side of a housing of the percussion mechanism.

14. The apparatus as claimed in claim 7, wherein said storage container comprises:

a container housing attached to said percussion mechanism;

a frangible glue bag received in said container housing; and piercing means, mounted on said container housing in communication with said duct, for piercing said gluebag to permit glue to be drawn therefrom.

15. The apparatus as claimed in claim 14, wherein said piercing means comprises a plug-in pipe in communication with said chamber via a conduit and a check valve.

* * * * *